US005570593A

United States Patent [19]

Neher et al.

[11] Patent Number: 5,570,593

[45] Date of Patent: Nov. 5, 1996

[54] STRAND FEEDING DEVICE

[75] Inventors: Paul Neher, Messstetten; Jürgen Hüfner, Albstadt, both of Germany

[73] Assignee: SIPRA Patententwicklungs-und Beteiligungs Gesellschaft mbH, Albstadt, Germany

[21] Appl. No.: 345,310

[22] Filed: Nov. 28, 1994

Related U.S. Application Data

[63] Continuation-in-part of Ser. No. 85,553, Jun. 30, 1993, abandoned, which is a continuation of Ser. No. 878,045, May 4, 1992, abandoned.

[30] Foreign Application Priority Data

May 21, 1991 [DE] Germany ..... 41 16 497.0

[51] Int. Cl.[6] ..... D04B 15/48; B65H 51/00

[52] U.S. Cl. ..... 66/132 R; 242/47.01; 66/125 R

[58] Field of Search ..... 242/47.01, 47.12, 242/47.13; 66/132 R, 132 T, 125 R; 139/452; 364/469, 470

[56] References Cited

U.S. PATENT DOCUMENTS

| | | | |
|---|---|---|---|
| 3,418,831 | 12/1968 | Nance . | |
| 3,720,384 | 3/1973 | Rosen | 242/47.01 |
| 3,908,921 | 9/1975 | Jacobsson | 242/47.01 |
| 4,027,505 | 6/1977 | Mishcon et al. . | |
| 4,047,398 | 9/1977 | Fecker et al. | 242/47.01 X |
| 4,180,215 | 12/1979 | Nurk . | |
| 4,247,057 | 1/1981 | Jacobsson | 242/47.01 |
| 4,632,324 | 12/1986 | Gutschmit | 242/47.01 |
| 4,756,344 | 7/1988 | Takegawa | 242/47.01 X |
| 4,993,241 | 2/1991 | Carrotte | 242/47.01 X |

FOREIGN PATENT DOCUMENTS

| | | |
|---|---|---|
| 2313274 | 9/1974 | Germany . |
| 2312267 | 3/1977 | Germany . |
| 1760600 | 6/1981 | Germany . |
| 2743749 | 10/1984 | Germany . |
| 3909817 | 3/1989 | Germany . |
| 2939803 | 12/1989 | Germany . |

*Primary Examiner*—Michael R. Mansen
*Attorney, Agent, or Firm*—Michael J. Striker

[57] ABSTRACT

A strand feeding device can be switched from positive strand feed to intermittent strand feed and vice versa. This is achieved with the aid of a strand guide element which is associated with a lower edge of a storage drum and can be adjusted by an electromagnetic setting member selectively to a first position allowing the intermittent strand feed and a second position producing the positive strand feed.

12 Claims, 7 Drawing Sheets

STRAND FEEDING DEVICE

CROSS-REFERENCE TO RELATED APPLICATION

This application is a continuation-in-part of application Ser. No. 085,553 filed on Jun. 30, 1993, now abandoned, which in turn is a continuation application of application Ser. No. 878,045 filed on May 4, 1992, now abandoned.

BACKGROUND OF THE INVENTION

The invention relates to a strand feeding device with a storage drum and a strand guide element arranged in the region of the lower edge of the storage drum and being adjustable into a first position for intermittent strand feed and a second position for positive strand feed.

In devices using or consuming strands, e.g. textile machines, especially knitting machines, it is frequently desired to feed thread, strand, strip or wire type material or the like, referred to briefly as strands, selectively continuously or intermittently (DE-PS 2 939 803, U.S. Pat. Nos. 3,418,831, 4,027,505). Strand feed devices used primarily for this are so-called belt feeders, which have a rotatable strand drum with a first peripheral section in contact with a feed and transport conveyor formed as a belt and a second peripheral section free from the feed and transport conveyor. Accordingly, if the strand is between the first peripheral section and the feed belt, it is necessarily and continuously fed with a speed corresponding to the peripheral velocity of the strand drum or the transport velocity of the feed band (positive strand feed). If, however, the strand is arranged on the second peripheral section, it is only fed when a pull is exerted thereon by the device processing the strand (intermittent strand feed). To select the desired kind of feed, a strand guide element adjustable manually or automatically, especially under pattern control, is associated with the strand and can be coupled to a mechanical or electromagnetic control device and locates the strand on the first or the second peripheral section. Band feeders of this kind however involve two different disadvantages, which are unacceptable, especially in their use in knitting machines.

The first disadvantage consists in that the strand is drawn directly off a supply reel or the like during intermittent feed and can therefore only be fed with a comparatively high minimum tension. This is dependent on the one hand on the number of deflecting points between the strand feed device and the supply reel and on the other hand on the unavoidable fluctuations in tension imposed by the use of the supply reel and is determined more or less arbitrarily. Since no active feed device is provided in intermittent strand feed, unavoidable fluctuations in tension arise in this feed mode.

The second disadvantage consists in that, reliable changeover from positive to intermittent strand feed and vice versa presumes that the feed belt and the strand are in contact only over a small part of the circumference of the peripheral surface of the strand drum. Accordingly, it is hardly possible to effect the positive strand feed without some slip between the strand drum and the feed belt, so that differing strand tensions are unavoidable even in positive strand feed.

The two disadvantages last referred to do not occur in strand feed devices of the kind initially specified, so-called storage feeders. In fact known strand feed devices of this kind (DE-PS 1 760 600 or DE-PS 2 312 267) also have a strand guide element serving the purpose of selectively winding the strand off the storage drum tangentially with a speed corresponding precisely to the winding on speed (positive strand feed) or drawing the strand over the lower edge of the storage drum, substantially axially, i.e. overhead, with a speed dependent on the strand usage in the device (intermittent strand feed) In such strand feed devices the strand guide element can only be moved manually into the one or the other position, since it is not intended to bring the strand selectively into the one or the other position during running of the device using the strand, but is for setting the strand feed device either to permanent positive or permanent intermittent strand feed. In addition such storage feeders can be switched temporarily to intermittent strand feed if it is normally operating with positive strand feed, as is frequently desired during adjustment and repair work on knitting machines while substantially stationary or driven in creep mode.

The switching circuits or the like of the present invention are generally known in the art, for example in FIG. 1 to 4, of German offenlegungsschrift 23 13 274 which correspond to Great Britain patent 14 55 922 published on November 17, 1976. In FIGS. 2*a* to 4 there are disclosed four different switching circuits with respect to FIG. 1a, switch 11 is mechanically coupled with control element 9 in such a manner that if control element 9 is in the position shown in FIG. 1, the switch is in the position II. If the control element 9s is retracted, switch 11 is in position I. In switch position II, positive feed takes place, and in position II, intermittent feed takes place. Switch 11 is automatically controlled if the control element 9 is switched from one position to its other position. The same can be done in accordance with this invention, e.g. by means of the guide element 31 which can be compared with the control element 9 of the state of the art. The result of operating switch 11 of Offenlegungsschrift 23 13 274 is the same as disclosed in this application, i.e. a change between positive and intermittent speed.

SUMMARY OF THE INVENTION

It is, therefore, an object of this invention to design the strand feeding device of the kind referred to above in such a manner that automatic changeover between positive and intermittent strand feed is possible. A further object is to design the strand feeding device such that the changeover between positive and intermittent strand feed is electrically controllable.

In keeping with these objects and with others which will become apparent hereinafter, one feature of the present invention resides, briefly stated, in a strand feeding device which has a storage drum having an axis and a lower edge, onto which a strand can be wound with a plurality of turns to form a strand supply, an out-feed eye through which the strand can be drawn from the storage drum, a strand guide element, means for mounting said strand guide element in the region of the lower edge of the storage drum, an electromagnetic setting member coupled to said guide element for selectively moving said guide element into a first position for intermittent strand feed or a second position for positive strand feed, respectively, means active during intermittent feed for sensing of a minimum of strand supply on said drum, means for providing said drum with a predetermined maximum amount of strand whenever said sensor means senses that said minimum of strand supply is reached during intermittent strand feed such that the strand is always drawn from the strand supply on the drum when the strand guide element is in its first position, means active during positive feed for ensuring that the strand is drawn off the drum with the same speed as it is wound onto the drum when said guide element is in its second position, and an electronic pattern device coupled with said electromagnetic setting member for controlling said setting member such that said guide element can be moved automatically and during continuous knitting into said first position or said second position in accordance with a pattern of a fabric.

Through the invention there is provided in the first place a strand feeding device in the form of a storage feeder which can be set selectively and according to a pre-selected program to positive or intermittent strand feed. Since the strand can be wound with a plurality of turns on the storage drum in both kinds of feed, there is the substantial advantage over belt feeders that the positive feed is ensured reliably and the strand is only subject to the small tension needed for the overhead take-off of the strand from the storage drum during intermittent feed. Apart from this the control device can be made extraordinarily simple since in essence only an electronically controllable solenoid or rotary magnet is needed for the setting of the strand guide element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
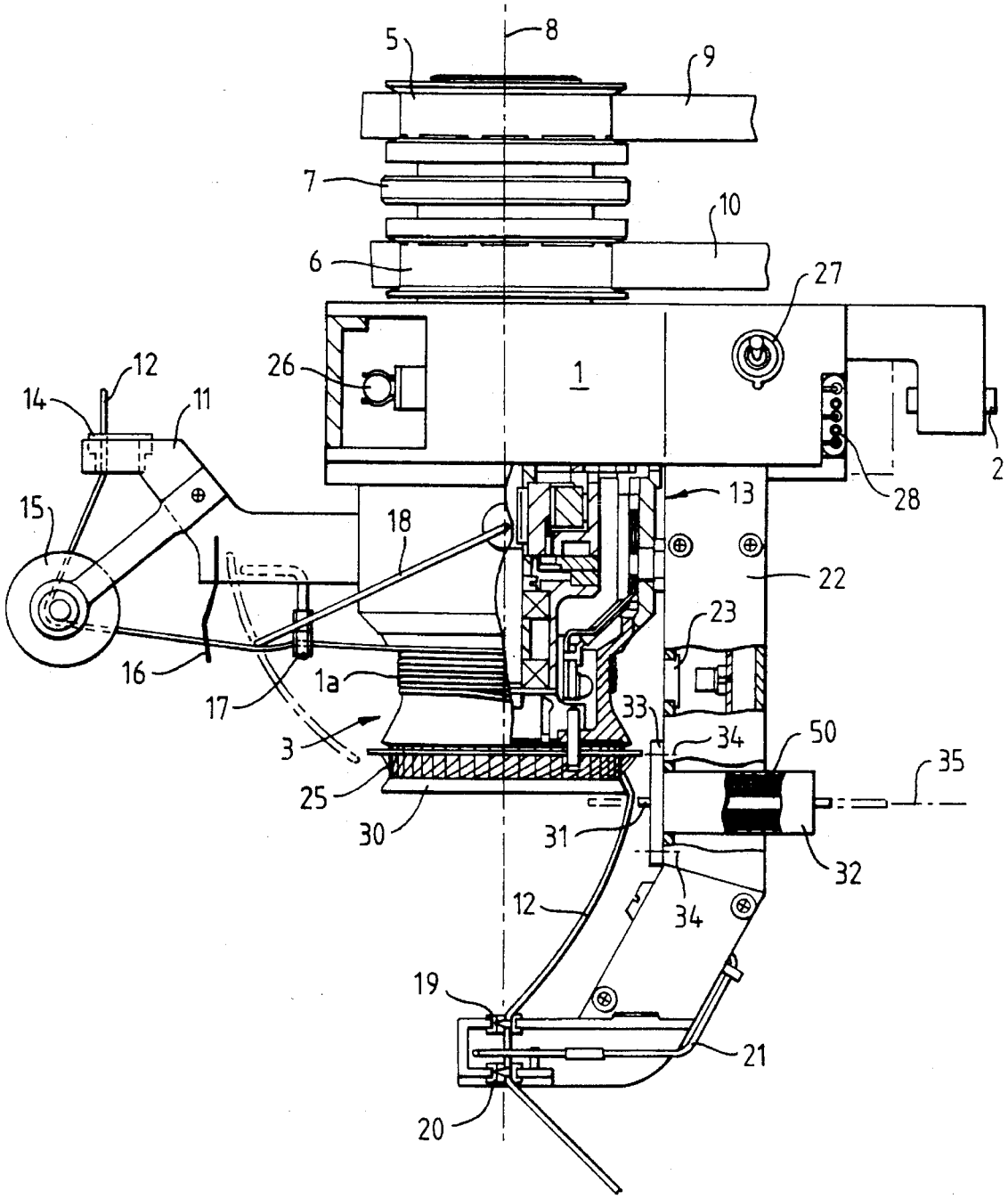
FIG. 1 an embodiment of thee strand feed device according to the invention in a partially sectioned front view.
Figure 7:
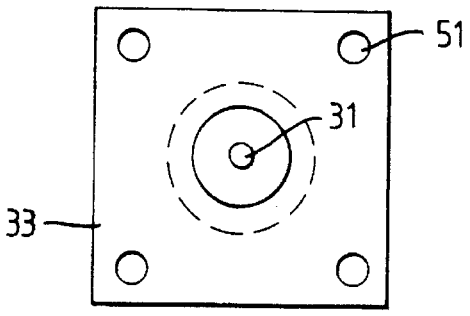

FIGS. *6a* and *6b* are views illustrating how it is possible to change operation between a positive feed and an intermittent feed;

FIG. 7 is a plan view of a setting member for selective adjustment for a strand guide element of the strand feed device according to FIG. 1.

Figure 8:
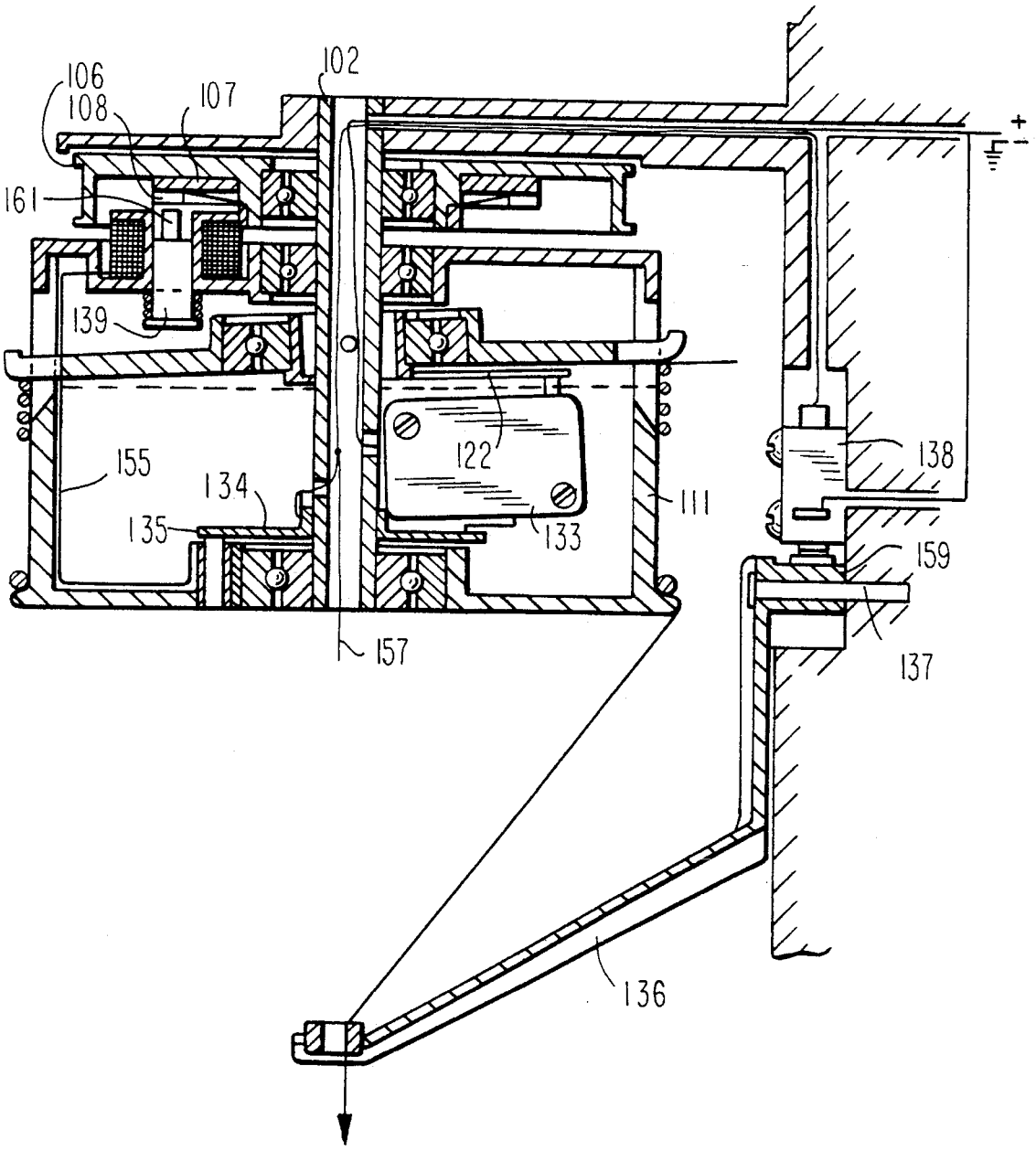

FIG. 8 is a plan view showing a part of the inventive strand feed device.

DESCRIPTION OF THE PREFERRED EMBODIMENTS

Figure 2:
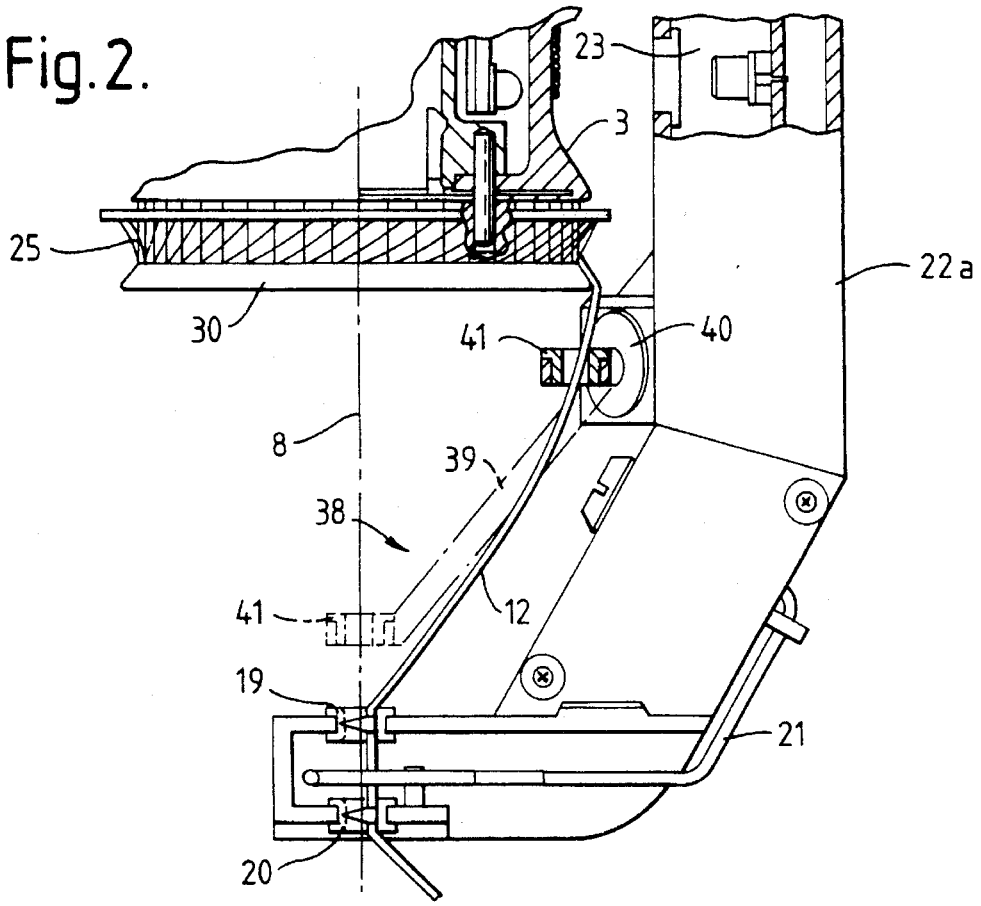
FIG. 2 is a partial front view and FIG. 3 is a partially sectioned plane view, to a larger scale than FIG. 1, of the strand feed device according to another embodiment of the invention.
Figure 3:
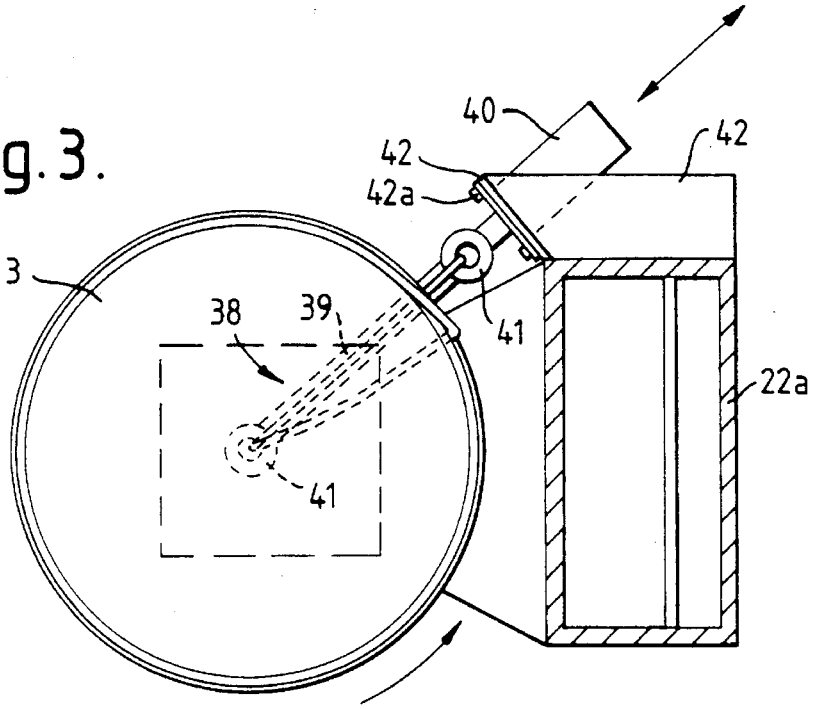

The strand feed devices shown in FIGS. 1 to 3 have a housing 1 formed as a hollow body, which can be fixed at one end by means of a screw 2 to a mounting rail of device using a strand, e.g. a circular knitting machine. On the underside of the housing 1 there is arranged a storage drum 3, which is fixed to a drive shaft rotatably mounted in the housing 1. Two drive wheels 5 and 6, e.g. belt or toothed belt pullers, serve for the drive of the shaft, being mounted coaxially and rotatably on an upwardly projecting part of the drive shaft. Between the two drive wheels 5 and 6 is mounted a manually shiftable clutch disc 7, coaxial with the drive shaft and so mounted on the projecting part of the drive shaft that it is rotationally fast with the drive shaft but can be shifted in the direction of a common axis 8 and coupled selectively to the drive wheel 5 or the drive wheel 6. The two drive wheels 5 and 6 are set in rotation by conventional drive elements 9 and 10, e.g. belts or toothed belts, where the drive elements can be driven with different speeds in the case of equal diameters of the drive wheels 5 and 6 or with equal speeds in the case of different diameters of the drive wheels 5 and 6. Alternatively it would be possible to provide only one drive wheel, in which case the storage drum 3 can only be driven at one speed of rotation.

On the free end of the housing 1 there is provided a support arm 11, on which there are arranged an in-feed eye 14, a strand brake 15, a slub monitor 16 and a further strand eye 17 for a strand coming from a conventional supply source, e.g. a supply reel. The free end of a sensor lever 18, pivotally mounted on the housing 1, terminates between the slub monitor 16 and the strand eye 17. A further strand eye 19, an out-feed eye 20 coaxial therewith but spaced therefrom and arranged therebetween, a sensor lever 21 pivotally mounted on the housing 1 are fitted to a further support arm 22 fixed to the housing 1. This arm also serving as a support for a sensor unit 23. The strand eye 19 and out-feed eye preferably being coaxial with the axis 8 and are fixed fast on the support arm 22. In the described arrangement, the strand passes during intermittent strand feed in turn through the in-feed eye 14, the strand brake 15, the slub monitor 16, the sensor lever 18 bearing thereon and the strand eye 17, before it is fed substantially tangentially on to the peripheral surface of the storage drum 3 driven by the drive wheel 5 or 6. From the storage drum 3, on which the strand is wound in a plurality of turns to form a strand supply, the strand 12 is fed through the strand eye 19, over the sensor lever 21 and through the out-feed eye 20 to the device using the strand 12.

In this path from the storage drum to the strand eye 19 the strand 12 moreover passes through an air gap, which is formed by a brake ring 25 sitting on the storage drum 3, and which can be omitted in positive strand feed, and the peripheral surface of the storage drum 3, before the strand 12 is fed to the device using it. In such an overhead take-off of the strand 12 the storage drum 3 is rotated intermittently and in dependence on the strand usage. For this purpose a clutch 13 arranged in the housing 1 but not described in detail is engaged or disengaged, i.e. rotated or stopped. As soon as the strand supply on the storage drum 3 falls below a minimum amount monitored by the sensor unit 23, the clutch 13 engages and the storage drum 3 is rotated. When the strand supply has then reached a predetermined maximum amount, likewise monitored by the sensor unit 23, the clutch 13 is disengaged, so that the storage drum 3 again stops. A preferred clutch 13 of this kind is known from DE-PS 2 743 749, to which reference is hereby expressly made.

Finally there can be fitted on or in the housing 1 a light 26 for indicating a strand breakage detected by the sensor levers 18 and 21, a manual switch 27 for manual actuation of the clutch for positive drive and the power supply 28 for the sensor arms 18 and 21, the sensor unit 23, the light 26 and the switch 27.

Strand feed devices of this kind and the functioning thereof are generally known (e.g. DE-PS 1 760 600, 2 312 267 and 2 743 749) so that further explanation can be dispensed with.

In the intermittent strand feed the strand 12 is drawn off over a lower edge 30 of the storage drum 3, widening conically radially outwardly. Its contact point on the edge 30 can wander freely in the circumferential direction in known manner, depending on whether the storage drum 3 is at rest at the moment or is rotated with a circumferential velocity which is greater than, equal to or less than the take-off speed of the strand 12.

In order to make possible positive strand feed also, a strand guide element 31 is associated with the storage drum 3, according to FIG. 1, which element is coupled to or formed as a part of an electromagnetic setting member 32. The setting member has a mounting plate 33 which is fixed to the support arm 22 by means of screws 34. In the particular case of Figure 1, the strand guide element 31 is formed as a pin with an axis 35 perpendicular to the axis 8 of the storage drum 3. It is slidable parallel to this axis 35, in that it is at the same time formed as the slidable armature of a solenoid forming the setting member 32. The strand guide element 31 can thus be set by means of the setting member 32 to a retracted first position, shown in FIG. 1 in full lines, and a projected second position shown in FIG. 1 in broken lines. The strand guide member 31 projects rearwardly out of the solenoid body in the first position.

The setting member 32 is arranged radially spaced from the axis 8 of the storage drum 3 by an amount which is greater than the radial spacing of the outermost end of the lower edge 30 from this axis 8. This distance is in particular sufficiently large for the retracted strand guide element 31 to leave enough of a gap between its front end facing the edge 30 for the customary overhead take-off of the strand 12 to be possible in intermittent and irregular strand feed. During this state the storage drum 3 is driven by means of the drive wheel 5 or 6 through the clutch disc 7 at a speed of rotation which is greater than the greatest possible take-off speed of the strand 12 or is at least equal thereto. Accordingly a strand supply builds up on the storage drum 3 and is monitored by the sensor unit 23, leading to the known engagement and disengagement of the drive i.e. the clutch 13 of the storage drum 3.

If however the strand guide element 31 is in the projected second position, its front end so projects under the lower margin of the edge 30, radially in the direction of the axis 8, that it prevents further circulation round the edge 30 during overhead take-off. In this case the strand can therefore only be drawn off with the same speed as it is wound on to the storage drum 3. Accordingly the storage drum 3 is driven in this case by means of the drive wheel 5 or 6 through the clutch 7 at a circumferential speed which corresponds precisely to the constant demand of the device using the strand. In this case the drive i.e. the clutch 13 is permanently engaged.

If the axis 35 of the pin-shaped strand guide element 31 is aligned radially with respect to the axis 8 of the storage drum 3, the direction of rotation of the storage drum 3 is optional. With other alignments of the strand guide element 31 it is however possible that it is only operative with one predetermined direction of rotation of the storage drum 3.

In the embodiment according to FIGS. 2 and 3, in which the same parts are provided with the same reference numerals, a strand guide element 38 is provided. As in FIG. 1 it is formed as a pin 39, which is at the same time the armature of a solenoid forming a setting member 40. In contrast to FIG. 1 the strand guide element 38 has a strand eye 41 in which the strand can be threaded on its end facing the storage drum 3, the eye being closed or partially open to facilitate laying in the strand 12. Moreover the axis of the strand guide element 38 is in accordance with FIG. 2 not perpendicular but inclined and arranged at an angle to the axis 8 of the storage drum 3 lying between 90° and 180° relative to the downwards extension of the axis 8.

In a retracted position of the strand guide element 38 shown in full lines in FIGS. 2 and 3 the strand eye 41 is so arranged closely beneath the lower edge 30 and radially at approximately the level of its greatest diameter that the strand 12 can only leave the edge 30 through the strand eye 41 arranged in a fixed position, before it passes through the eyes 19, 20, but cannot carry out the circulating movement around the edge 30 characteristic of intermittent strand feed. In this case the strand 12 is accordingly fed positively.

If however the strand guide element 38 and the strand eye 41 are located in a second position projected towards the axis 8, shown in broken lines in FIGS. 2 and 3, the strand eye 41 is substantially coaxial with the axis 8 and arranged a significant distance below the storage drum 3. In this case the strand 12 can accordingly be drawn off over the head, i.e. with intermittent strand feed. The distance of the strand eye 41 from the lower edge 30 of the storage drum 3 in this position is dependent mainly on the angle between the axis 8 and the axis of the pin 39 along which the displacement of the strand eye 41 takes place. An advantage of the strand eye 41 lies in that the strand is kept constantly under control even during the changeover from positive to intermittent strand feed and vice versa.

Furthermore the setting member 40 is fixed to a support arm 22 of the strand feed device by means of a mounting plate 42 and screws **42*a* similarly to FIG. 1. Since the strand eye 41 has the same effect during intermittent feed as the eyes 19, 20, the latter could even be omitted. The sensor lever 21** could be replaced by another device in this case.

Figure 4:
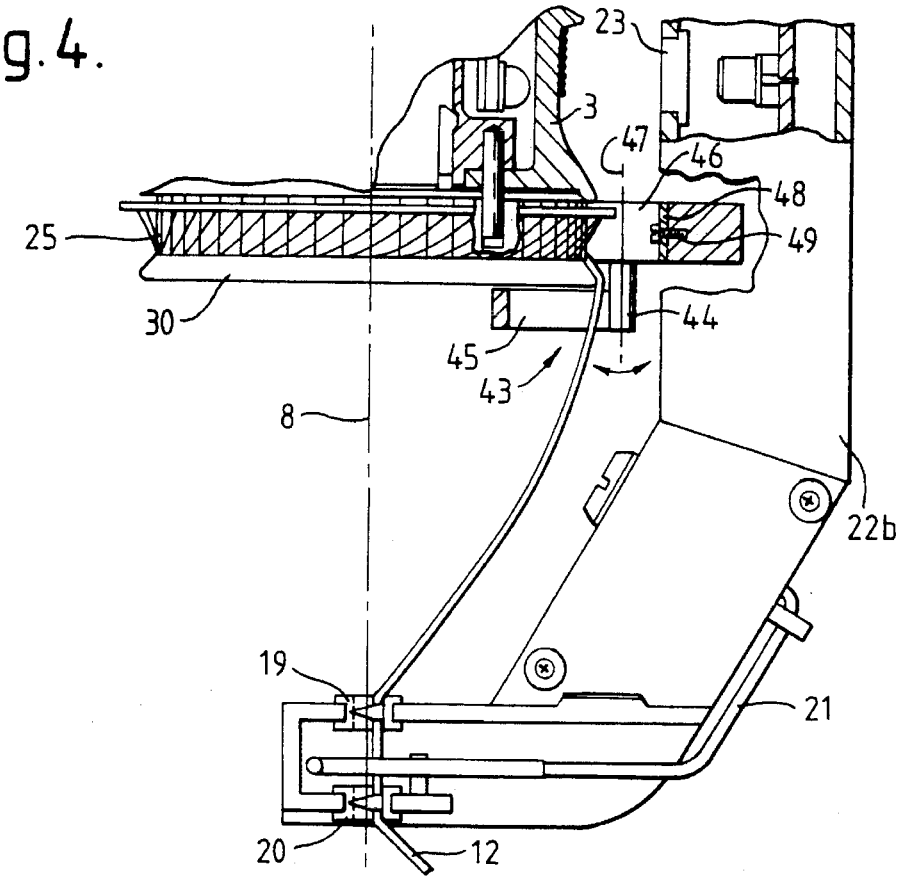
FIG. 4 is a partial front view and FIG. 5 is a partially sectioned plane view, to a larger scale than FIG. 1, of the strand feed device according to still another embodiment of the invention.
Figure 5:
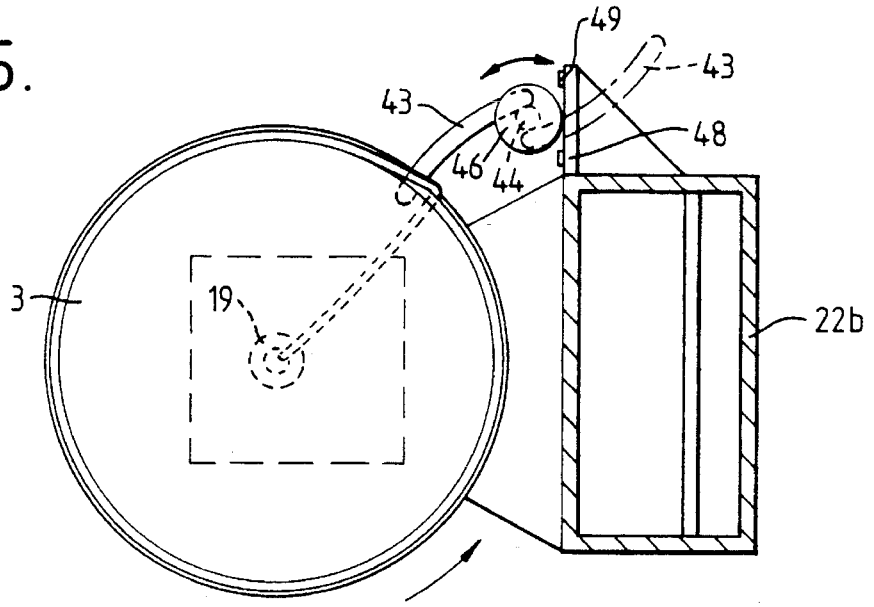

In the embodiment according to FIGS. 4 and 5, in which the same parts are again given the same reference numerals, a strand guide element 43 is provided extending transversely to the axis 8.of the storage drum 3. This element is bent like a hook and coupled at one end to a rotary spindle 44 and provided in a central part with a receiving pocket 45 shaped like a jaw or an eye for the strand 12. The rotary spindle 44 is part of a rotary electromagnet forming a setting member 46 and can be rotated by this about an axis 47 running parallel to the axis 8.

The strand guide element 43 can be rotated by means of the setting member 46 at least into a first position retracted from the axis 8, shown in broken lines in FIG. 5, and a second position projected towards the axis 8, shown in full lines in FIGS. 4 and 5. The setting member 46 is again arranged at a great enough radial spacing from the axis 8 for the strand guide element 43 to form a sufficiently large gap between itself and the lower edge 30 in the first position for the usual over-the-head take-off of the strand 12 to be possible. It is arranged closely beneath the outermost radial margin of the lower edge 30 in its second position, in order to prevent the strand 12 running round this edge 30, as is necessary for positive strand feed. On account of the hook-shaped form of the strand guide element 43, the sense of rotation of the storage drum 3, the receiving pocket 45 of the strand guide element 43 and the sense of rotation of the rotary spindle 44 are so matched to one another that the strand 12 automatically falls into this receiving pocket 45 during positive feed and can come out of it without hindrance on switching to intermittent strand feed.

Furthermore the setting member 46 is fixed by means of a mounting plate 48 and screw 49 to a support arm **22*b*** of the strand feed device.

Figure 6:
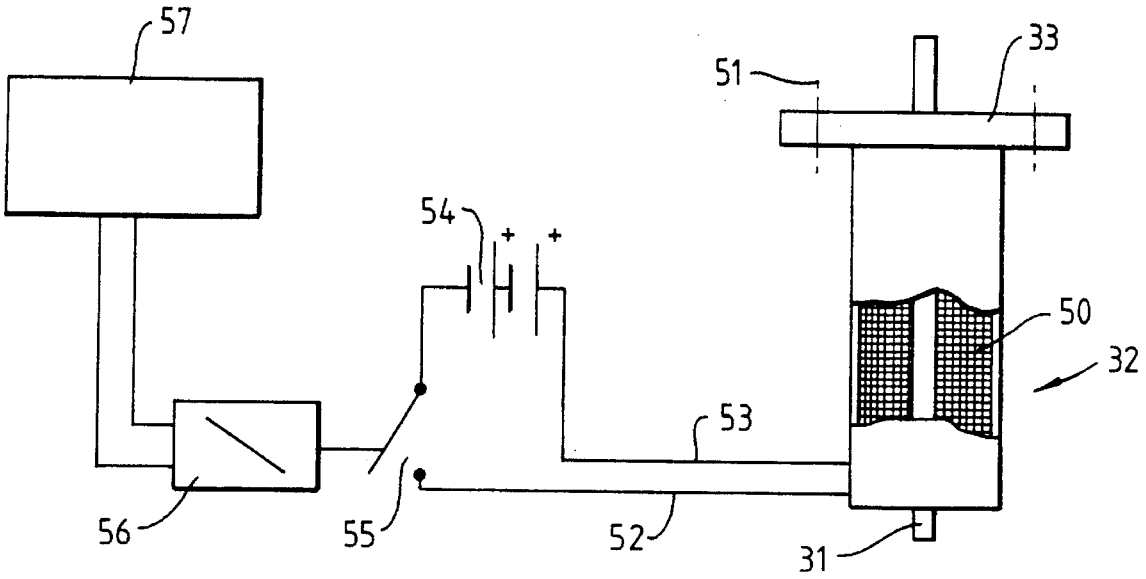
FIG. 6 is a schematic view of a controlled device of the strand feed device according to the invention.

FIGS. 6 and 7 show the setting member 32 consisting of a solenoid of conventional construction to an enlarged scale. The setting member 32 includes in particular a magnetic winding 50, which has two terminals 52, 53 and is fixed on the mounting plate 33 having screw holes 51 for the screws 34. The two terminals are connected by electric wires to a current supply 54, i.e. a battery or the like, suited to whether a direct or alternating current magnet is involved. Switch 55 is connected in one of these wires and can be opened and closed by means of a relay 56, in order to bring the strand guide element 1 into the projected state by making the terminals 52, 53 to the current supply or into the retracted state by opening the switch 55.

The relay 56 is connected to an electronic pattern device 57, which forms with the relay 56, the switch 55 and setting member 32 an electronic control device for the strand guide element 31. The pattern device 57 can be formed in conventional manner and brings the strand guide element 31 into one or the other position in accordance with a pattern stored on a program carrier, e.g. a stripe pattern. In particular the pattern device 57 for the strand guide element 31 can be a circuit arrangement known per se (DE-OS 3 909 817) which is connected to a pattern device for the needles of a knitting machine. It sends signals to the relay 56 in dependence on "0" or "1" signals, i.e. turns the relay 56 on or off, which appear as a predetermined signal sequence at the output of a pattern device for the knitting needles. In this manner it would be possible e.g. to energize the relay 56 constantly and thereby set the strand feed device to positive strand feed after a predetermined number of sequential needle have been selected to knit or after the end of such a signal sequence, e.g. on appearance of the first signal selecting a needle to miss, to open the switch 55 again and thereby change over the strand feed device to intermittent strand feed again, before the predetermined number of sequential needles are again selected for knitting.

In addition it can be provided that, on the appearance of the knitting signals for the predetermined number of knitting needles it is determined by electronic means whether sufficient further knitting needles follow this sequence and accordingly whether the changeover to positive strand feed is actually necessary. The number of needles which will still knit the strand during the changeover phase can also be taken into account by means of suitable software.

The changeover instant from intermittent to positive strand feed or vice versa could alternatively be controlled by a sensing lever sensing the strand feed, in that there is a switch to positive strand feed on sensing a certain continuity in the strand feed, as takes place when all needles knit. If this continuity is no longer present, as is the case with irregular strand usage, e.g. during Jacquard selection of the knitting needles, operation is switched to intermittent.

The drive to the storage drum 3 is moreover so controlled in known manner that the storage drum 3 is permanently coupled to one of the drive wheels 5 and 6 through the clutch 13 during positive drive. In intermittent drive it is only coupled to one of the drive wheels 5 and 6 through the clutch 13 as required and at the same time, by means of the sensor unit 23, in such a way that a certain minimum supply of strand on the storage drum is ensured.

Further possibilities for controlling the relay 56 will be found in the state of the art (e.g. DE-PS 2 939 803, U.S. Pat. No. 3,418,831, 4,027,505), so that these need not be further explained.

In use of the described strand feed device with other strand-using machines, especially textile machines, corresponding possibilities for control arise. It is evident that the control device according to FIGS. 6 and 7 can also be used with the strand devices according to FIGS. 2 to 5, viz. with their setting members 40 and 46.

The invention is not limited to the described embodiments, in which many changes are possible. For example more than two drive wheels 5, 6 as well as means for stepless alteration of the speed of rotation of the storage drum 3 during positive strand feed could be provided. These means consist for example of a drive wheel of variable diameter, a steplessly variable gear or interchangeable gearwheels within the drive for the feed and transport belts 9 and 10. Furthermore it would be possible to arrange the setting member 32, 40 or 46 radially inside the projection of the storage drum 3 rather than radially outside this projection. In addition other strand guide element than those shown and other than the setting members shown can be used. In particular it would be possible to use the armatures of solenoids or rotary magnets not directly as the strand guide elements or to couple them thereto but for example to provide between the strand guide elements and the armatures lever mechanisms or the like, for example to magnify the stroke of the strand guide element relative to the stroke of the magnet, or transmission members for the fastest switching operations.

The closed or open solenoids of the firm Harting of D-4992 Espelkamp for example are suitable as solenoids and available with strokes of 3 to 24 mm. In the use of rotary magnets the stroke of the armature created by a solenoid is converted into a rotary movement of a rotary spindle, which can be effected in known manner inside or outside the magnet body with the aid of a coarse thread coupling the armature to the rotary spindle.

It is further possible either to form the storage drum 3 as a rotary drum or to mount it in fixed position and this case to effect the winding on of the strand with an additional winding arm (DE-PS 1 760 600). In place of the drive for the continuous or intermittent rotation of the storage drum 3 there is then a suitable drive for the winding arm.

With respect to the function of the clutch in the positive feed mode, reference is made to U.S. Pat. Nos. 3,720,384. At column 6, line 3 through column 7, line 31 of U.S. Pat. No. 3,720,384 it is disclosed, similarly to this application, that pulley 106 (corresponding to pulleys 5 and 6 of this application) is driven e.g. by the knitting machine, particularly by means of a belt (see also column 4, lines 16–18). At column 7, lines 1–25, of U.S. Pat. No. 3,720,384 the positive feed mode is explained. It is disclosed, that by swinging the arm 136 to the positive feed position, switch 138 is activated. By means of this, switch 133 is bridged and a source of power (± line in FIG. 8) is coupled via lead line 158 and switch 138 to lead line 157 and thus via conductor 134, slip contact 135 and lead line 155 to magnet 139 (corresponding to clutch 13 of this application) such that magnet 139 permanently engages ring 107 by means of plunger 161 and detent 108, and drum 111 is permanently and positively driven by wheel 106 via shaft 102. Contrary, during intermittent feed mode, switch 138 is switched off by means of an eccentric 159 on arm 136, and switch 133 will be now intermittently activated by means of flange 122 (column 6, lines 22 through 53) such that the source of power can be coupled via switch 133, conductor 134, slip contact 135 and line 155 to magnet 139 whenever it is necessary to refill the drum 111.

It must be summarized that according to the known state of the art the drum is permanently coupled during positive feed to a driving means (wheel 106 in U.S. Pat. No. 3,720,384, one of wheels 5 and 6 of this application) whereas during intermittent feed the drum is only coupled to the driving means is necessary to refill the drum. Exactly the same function as disclosed at the end of U.S. Pat. No. 4,180,215 of the same applicant. The means for coupling and decoupling are designated as a magnet in U.S. Pat. No. 3,720,384 and as a clutch in U.S. Pat. No. 4,180,215, both means being similar and operate by means of magnetic forces. Further, particularly the U.S. Pat. No. 3,720,384 discloses that one approach to enable the sensor (flange 122 in FIG. 3 of U.S. Pat. No. 3,720,384 and sensor 23 in this application) from engaging and disengaging the clutch (magnet 139 in U.S. Pat. No. 3,720,384, clutch 13 in this application) in response to the strand supply on the drum simply is to bridge a switch (e.g. 133 in U.S. Pat. No. 3,720,384) and to permanently couple a source of power to the clutch if desired. A plurality of other means can be provided. According to a more modern state of the art, simple microprocessors or the like will be used to selectively couple the clutch permanently or selectively to a source of power.

Switching circuits or the like of the present invention are generally known in the art, for example in FIG. 1 to 4 of German Offenlegungsschrift 23 13 274 which correspond to Great Britain patent 14 55 922 published on Nov. 17, 1976. In FIGS. 2*a* to 4 there are disclosed four different switching circuits. With respect to FIG. 1*a*, switch 11 is mechanically coupled with control element 9 in such a manner that if control element 9 is in the position shown in FIG. 1, the switch is in the position II. If the control element 9s is retracted, switch 11 is in position I. In switch position II, positive feed takes place, and in position II, intermittent feed takes place. Switch 11 is automatically controlled if the control element 9 is switched from one position to its other position. The same can be done in accordance with this invention, e.g. by means of the guide element 31 which can be compared with the control element 9 of the state of the art. The result of operating switch 11 of Offenlegungsschrift 23 13 274 is the same as disclosed in this application, i.e. a change between positive and intermittent speed.

Figure 6A:
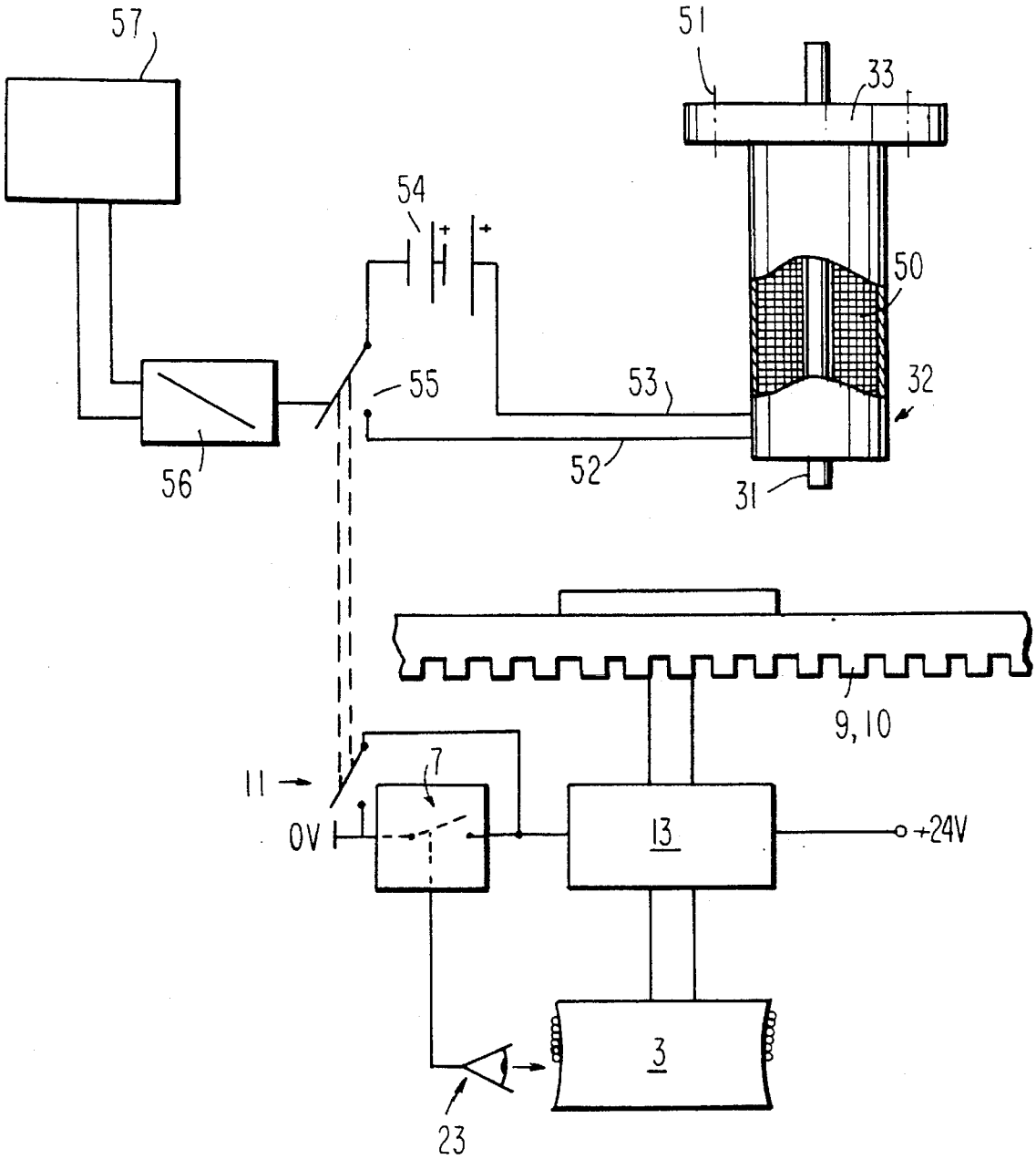
Figure 6B:
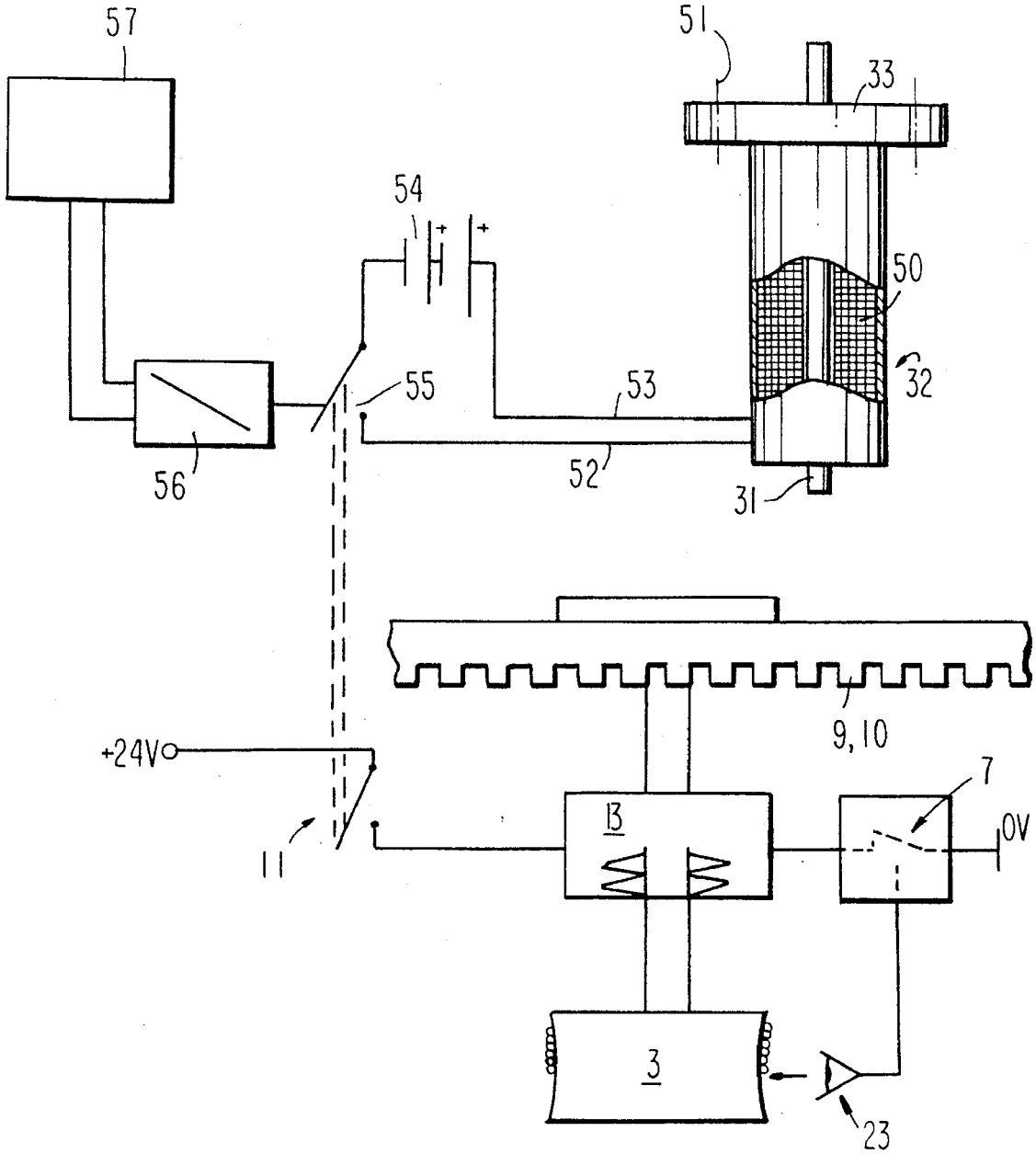

FIGS. 6*a* and 6*b* additionally show how it is possible to change from one mode to the other. According to FIG. 6*a*, the drum 3 is coupled via clutch 13 to drive elements 9 or 10. The sensor unit 23 senses the strand being stored on the drum 3 and includes a switching means 7 acting on the clutch. This switch corresponds to switch 7 of Offenlegungsschrift 23 13 74. A further switch 11 corresponds to switch 11 of Offenlegungsschrift 23 13 274. The switching means 7 and the clutch 13 are connected between 0 V and e.g. +24V. Switch 11 can be actuated in the same manner as in Offenlegungsschrift 23 13 274 or can be switched as shown in enclosure by means of relays 56 shown in FIG. 6 of this application, i.e. via pattern device 57. If switch 11 is open, and the sensor unit 23 can operate (intermittent feed), i.e. if sensor 23 senses that drum 3 is nearly empty, the switch 7 is closed such that clutch 13 is activated to couple drum 3 with means 9, 10. If the sensor 23 senses that again enough thread is wound onto the drum, switch 7 is opened and clutch 13 is disengaged such that the drum 3 is stopped. If desired, pattern device 57 actuates relays 55 and closes switches 55 and 11. By closing switch 55, the magnet is activated and the element 31 is controlled such that positive feed starts. At the same time, the closure of switch 11 brides the sensor unit 23 in such a manner, that clutch 13 is permanently engaged and drum 3 is permanently coupled to means 9, 10 as long as relays 56 holds switch 11 in the closed position. In this mode of operation the position of switch 7 has no influence in clutch 13. If again intermittent feed is desired, relays 56 opens switch 55 to disenergize the magnet, and also opens switch 11 to again make the operation of clutch 13 dependent from the sensor unit 23.

A second embodiment is shown in FIG. 6*b*. In this embodiment, clutch 13 is under the force of a spring and always engaged if no current flows. If switch 11 is open (via relays 56 of FIG. 6), then clutch 13 is engaged and the drum 3 is coupled to means 9, 10 which means positive feed. The sensor unit 23 cannot activate clutch 13 in this mode of operation even if switch 7 should be closed because switch 11 is open. If relays 56, however, closes switch 11, then sensor unit 23 can open and close switch 7 and engage and disengage the clutch in accordance with the quantity of yarn on the drum 3. If switch 7 is open, no current flows and the clutch is engaged by means of the spring. If switch 7 is closed (and also switch 11), a current flows such that the clutch 13 is disengaged against the spring force.

Thus, the two embodiments substantially operate in the same manner as the circuits shown in Offenlegungsschrift 23 13 274. Of course there can be a plurality of other embodiments.

The strand feed device according to the invention is suitable for use in conjunction with knitting machines, especially circular knitting machines, above all for the production of large area Jacquard patterns in plain-plain or plain-purl knitting or plain-purl plush knitting, where the strand feed takes place positively in large, un-patterned regions and intermittently in small patterned regions.

It will be understood that each of the elements described above, or two or more together, may also find a useful application in other types of constructions differing from the types described above.

While the invention has been illustrated and described as embodied in a strand feeding device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A strand feeding and storage device, comprising a storage drum having an axis and a lower edge, onto which a strand can be wound with a plurality of turns to form a strand supply, an out-feed eye through which the strand can be drawn from the storage drum, a strand guide element, means for mounting said strand guide element in the region of the lower edge of the storage drum, an electromagnetic setting member coupled to said guide element for selectively moving said guide element into a first position for intermittent strand feed and a second position for positive strand feed, respectively, means active during intermittent feed for sensing of a minimum of strand supply on said drum, means for providing said drum with a predetermined maximum amount of strand whenever said sensor means senses that said minimum of strand supply is reached during intermittent strand feed such that the strand is always drawn from the strand supply on the drum when the strand guide element is in its first position, means active during positive feed for permanently providing said drum with the strand at a speed corresponding to a speed with which a device using said strand draws off said strand from said drum when said guide element is in its second position, and an electronic control device including said electromagnetic setting member for controlling said setting member such that said guide element can be moved automatically and during continuous knitting into said first position and said second position in accordance with a pattern of a fabric.

2. A strand feeding device according to claim 1, wherein the strand guide element consists of a pin movable transverse to the axis of the storage drum.

3. A strand feeding device according to claim 2, wherein the setting member is a solenoid coupled to the strand guide element and designed to move said strand guide element linearly.

4. A strand feeding device according to claim 3, wherein the setting member is a solenoid coupled to the strand guide element and designed to move it linearly.

5. A strand feeding device according to claim 4, wherein the solenoid is arranged radially spaced from the axis of the storage drum by a distance which is greater than the greatest radial distance of the lower edge of the storage drum from this axis.

6. A strand feeding device according to claim 3, wherein the pin is formed as an armature of a solenoid forming the setting member.

7. A strand feeding device according to claim 2, wherein the strand guide element is formed as an armature of a solenoid forming the setting member.

8. A strand feeding device according to claim 1, wherein the strand guide element is movable obliquely relative to the axis of the storage drum and carrying said out-feed eye.

9. A strand feeding device according to claim 8, wherein a strand eye is arranged in the second position of the strand guide element closely beneath the lower edge of the storage drum and is arranged in the first position of the strand guide element significantly below the storage drum and substantially coaxial therewith.

10. A strand feeding device according to claim 1, wherein the strand guide element consists of a hook arranged transverse to the axis of the storage drum and with a receiving pocket, the hook being mounted to rotate about an axis running substantially parallel to the axis of the storage drum.

11. A strand feeding device according to claim 10 wherein the strand guide element is coupled to a rotary spindle of a rotary magnet forming the setting member.

12. A strand feeding device according to claim 1, wherein the storage drum is rotatably mounted for winding on the strand and is provided with a controllable drive.

* * * * *